United States Patent [19]

Szarka

[11] Patent Number: 4,939,991

[45] Date of Patent: Jul. 10, 1990

[54] MULTICOLOR SCREEN PRINTING ASSEMBLY

[75] Inventor: Sandor Szarka, Franklin Lakes, N.J.

[73] Assignee: Precision Screen Machines, Inc., Hawthorne, N.J.

[21] Appl. No.: 304,936

[22] Filed: Feb. 2, 1989

Related U.S. Application Data

[63] Continuation of Ser. No. 118,429, Nov. 6, 1987, abandoned.

[51] Int. Cl.[5] ..... B41F 15/04

[52] U.S. Cl. ..... 101/115; 101/123

[58] Field of Search ..... 101/115, 123, 126

[56] References Cited

U.S. PATENT DOCUMENTS

| | | | |
|---|---|---|---|
| 2,485,289 | 10/1949 | Jáne | 101/115 |
| 2,609,747 | 9/1952 | Schwartz et al. | 101/115 |
| 2,690,118 | 9/1954 | Schwartz et al. | 101/115 |
| 3,370,569 | 2/1968 | Runge | 101/123 X |
| 3,505,951 | 4/1970 | Gartrell | 101/123 |
| 3,543,679 | 12/1970 | Wahl | 101/126 X |
| 3,638,564 | 2/1972 | Prange et al. | 101/126 X |
| 3,650,208 | 3/1972 | Lambert | 101/114 X |
| 4,254,707 | 3/1981 | Lambert et al. | 101/123 |
| 4,287,826 | 9/1981 | Brabec | 101/123 X |
| 4,493,254 | 1/1985 | Landesman et al. | 101/115 X |

FOREIGN PATENT DOCUMENTS

| | | | |
|---|---|---|---|
| 1460782 | 3/1969 | Fed. Rep. of Germany | 101/115 |
| 306511 | 3/1930 | United Kingdom | 101/115 |

*Primary Examiner*—Clifford D. Crowder

*Attorney, Agent, or Firm*—Hopgood, Calimafde, Kalil, Blaustein & Judlowe

[57] ABSTRACT

A screen printing machine has a plurality of stationary printing head frames each with a bell crank linkage suspending a framed screen mounting assembly for parallel movement of the screen into and out of engagement with a pallet supported article to be printed. The head frames are integrated into the machine structural frame in both a rotatable pallet embodiment and a linear web embodiment. Separate actuators are carried by a carriage, the latter being moveable along the head frame from one end to the other, the actuators being arranged to lower and raise separate flood bars and squeegee blades, correlating the up-and-down movement of the flood bars and squeegee blades with the raising and lowering of the screens.

8 Claims, 9 Drawing Sheets

MULTICOLOR SCREEN PRINTING ASSEMBLY

This application is a continuation of application Ser. No. 118,429, filed Nov. 6, 1987, now abandoned.

BACKGROUND OF THE INVENTION

The present invention relates to screen printing machines and more particularly to an improved printing head assembly and the machine resulting therefrom.

Heretofore, in screen printing machines for printing on fabric material, and particularly on articles of clothing, the printing head frames have been pivotally mounted at one end in a cantilevered arrangement with the framed-screen support carried in fixed position by the printing head frame. With an article to be printed supported on a pallet beneath a printing frame head, the latter was lowered from a raised position, like the lowering of a drawbridge, to position the screen down upon the article in question. Then flood and squeegee blades were operated to accomplish a flooding stroke followed by a squeegee stroke. Thereafter the entire printing head was raised to free the underlying article and pallet.

A typical example of a printing head construction as outlined above is described in U.S. Pat. No. 3,885,493 issued May 27, 1975 to Precision Screen Machines, Inc. on an application by David Jaffa. In another Jaffa patent, U.S. Pat. No. Re. 29,160, reissued Mar. 29, 1977 and entitled "Screen Printing Machine With Oval Rail For Indexing Pallets", there is described a screen printing machine having an oval track or rail about which a series of pallets supporting a workpiece are indexed from station to station. The arrangement is such that the pallets travelling about the oval rail are always disposed or maintained in a common plane. A printing head assembly having one or more color stations, is operatively associated for movement into and out of printing relationship with one or more of the pallets as the pallets are indexed and maintained in a common plane.

As a variant on the oval track arrangement, machines have been built where the pallets are arranged at the ends of radial arms extending from a central vertical shaft and index around a circular path as the shaft rotates. Both the oval track and circular path machines were constructed with hinged cantilever printing heads. Each such printing head represented a large physical mass which, during machine operation, caused noticeable and often objectionable machine vibration. Also, large motive devices or actuators were required to move the printing heads, and a massive machine structure was required to produce an apparatus capable of operating at acceptable production speed.

Therefore, it is an object of the present invention to provide a screen printing machine capable of operating at higher speed than presently known machines. It is a further object to provide such machine operation with a concomitant reduction in vibration. It is also an object to provide for economy of operating power while obtaining equal or better throughput than heretofore obtainable with known machines.

SUMMARY OF THE INVENTION

In accordance with one aspect of the present invention there is provided a screen printing machine comprising in combination a central base structure supporting thereupon a rotatable column, a plurality of circumferentially spaced radial arms projecting from said column and supporting each a corresponding pallet at the same radial distance from said column and in a common plane for receiving a fabric article to be screen printed, a plurality of printing head frame assemblies disposed in another common plane parallel to and spaced from said pallet common plane, said printing head frame assemblies being located about a circle spaced from one another and positioned radially from said column so that, for each of a plurality of indexable locations of said rotatable column, each printing head frame will be aligned in juxtaposition with a different pallet, and machine frame members interconnecting one end of each said printing head frame assembly with said rotatable column, and connecting the opposite end of each said printing head frame assembly with said base structure whereby said printing head frame assemblies are integrated into a boxlike rigid skeletal machine frame, and means supported by each said printing head frame assembly for screen printing upon a pallet-supported article when a printing head frame assembly and a pallet are in juxtaposition.

In accordance with another aspect of the present invention there is provided a screen printing machine comprising in combination a plurality of printing head frame assemblies disposed in a common plane, means for supporting and advancing in a second plane, spaced from and parallel to said common plane, a quantity of fabric onto which printing is to be effected, means for advancing said fabric to sequentially locate a predetermined area of said fabric in registration with a different one of said head frame assemblies, and machine frame members interconnecting each end of each of said printing head frame assemblies with a machine base structure whereby said printing head frame assemblies are integrated into a rigid skeletal machine frame, and means supported by each said printing head frame assembly for screen printing upon said fabric when said predetermined area is in juxtaposition with the corresponding printing head frame assembly.

In accordance with yet another aspect of the present invention there is provided a screen printing machine comprising in combination a printing head frame assembly mounted in a fixed horizontal position above a printing station, means for supporting below said printing head frame assembly an article onto which an image is to be printed, and means supported by said printing head frame assembly for screen printing upon said article when the latter is supported beneath said printing head frame assembly, said last mentioned means comprising a vertically selectably reciprocable screen frame mount in combination with a vertically reciprocable and horizontally translatable squeegee assembly for sequentially lowering a screen into contact with said article and thereupon translating said squeegee to urge printing fluid through said screen.

BRIEF DESCRIPTION OF THE DRAWINGS

The invention will be better understood after reading the following detailed description of the presently preferred embodiments thereof with reference to the appended drawings in which.

The same reference numerals are used throughout the various figures of the drawings to designate the same or similar parts.

DETAILED DESCRIPTION OF THE PRESENTLY PREFERRED EMBODIMENTS

Figure 1:
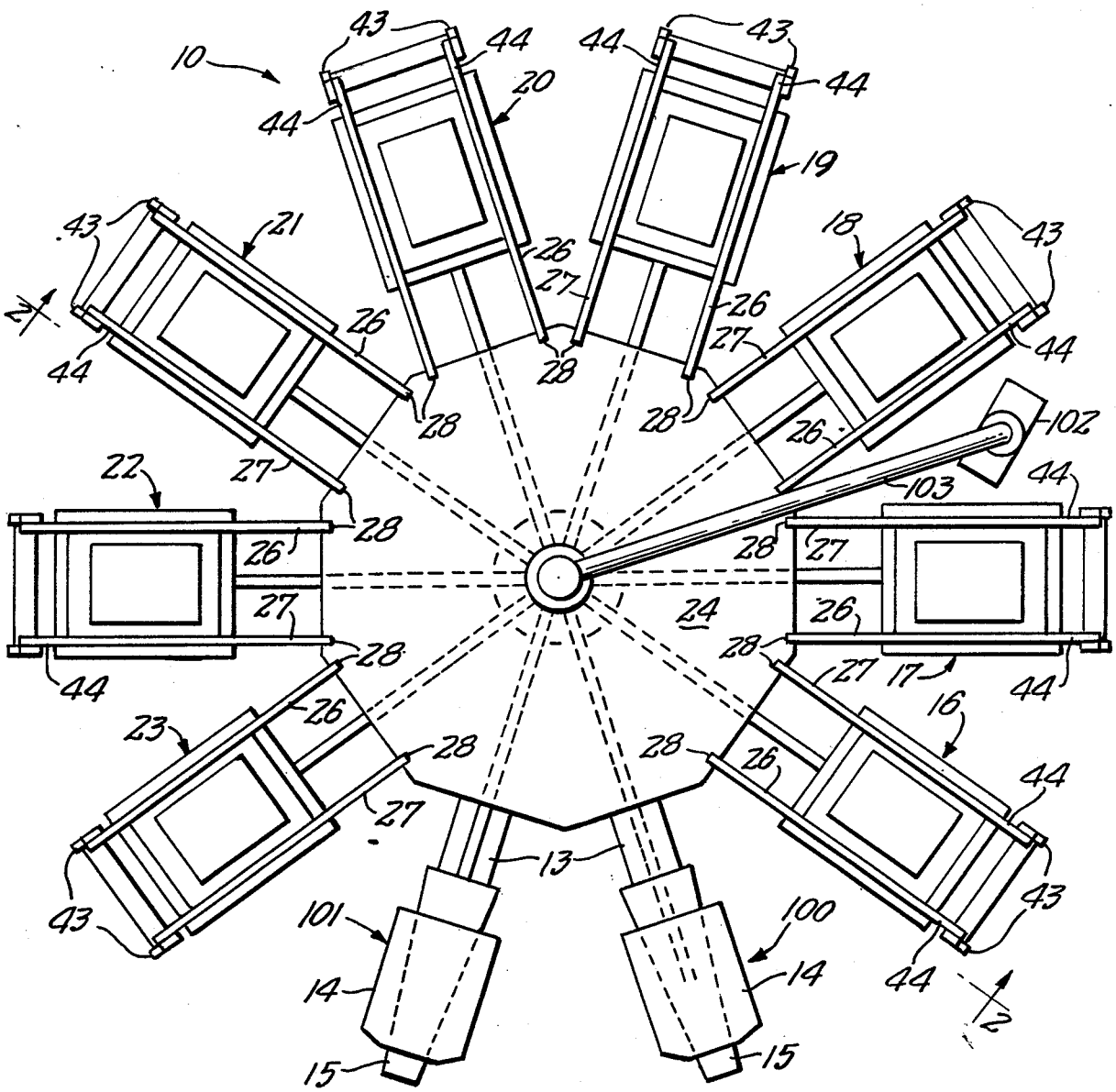
FIG. 1 is a top plan view of a screen printing machine embodying the present invention wherein the printing head frame assemblies are disposed along circumferentially spaced radii and integrated into the machine frame.
Figure 2:
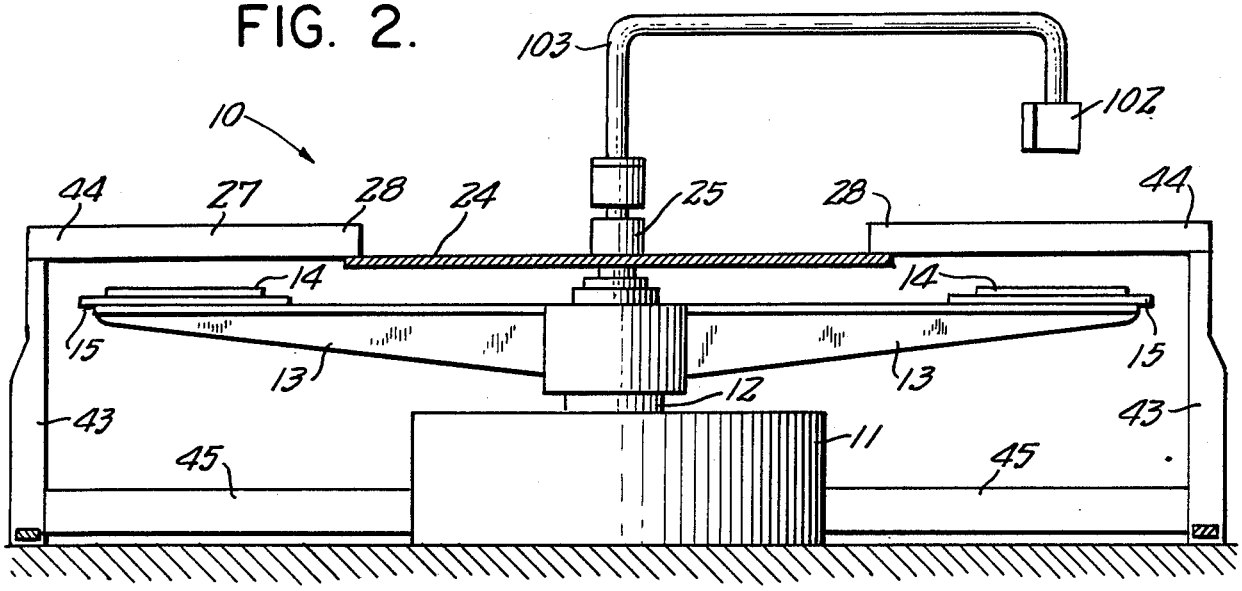
FIG. 2 is a transverse sectional view taken along line 2—2 in FIG. 1.
Figure 4:
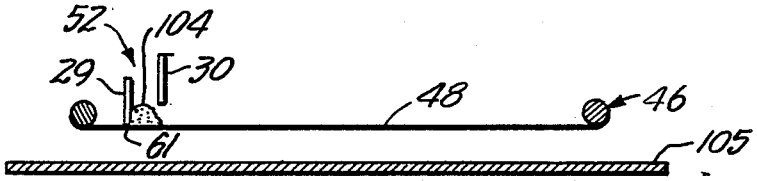
FIGS. 4 to 10 are diagrammatic views illustrating the operating sequence of the printing head in the machine of FIG. 1.

Referring now to FIGS. 1 and 2 there is shown a screen printing machine, designated generally by the reference numeral 10, which machine has a central base structure 11 supporting thereupon a rotatable column 12. A plurality of circumferentially spaced radial arms 13 project from column 12 mounted in cantilever fashion thereon. Each of the arms 13 supports a corresponding pallet 14, all pallets being supported at the same radial distance from the column 12 and in a common plane. The pallets 14 are removeably mounted upon a carrier plate 15 so that the pallets can be changed for matching size and or shape requirements. Each pallet 14 is constructed to receive a fabric article to be screen printed.

A plurality of printing head frame assemblies 16 to 23, are disposed in another common plane parallel to and spaced from the pallet common plane. As shown, the printing head frame assemblies, 16 to 23, are located about a circle spaced from one another and positioned radially from the column 12 so that, for each of a plurality of indexable locations of the column, each printing head frame assembly, 16 to 23, will be aligned in juxtaposition with a different one of the pallets 14.

As part of the overall machine frame structure there is provided a central cap 24 including a centered bearing 25 for the rotatable column. The printing head frame assemblies 16 to 23 comprise radial beams 26 and 27 joined at an end 28 to the cap 24, and extending radially outwardly in pairs with the pairs spaced circumferentially and each pair defining a stationary printing station. Vertical standards 43 interconnect the free ends 44 of the beams 26 and 27 with radially extending extensions 45 projecting from the central base structure 11.

Figure 3:
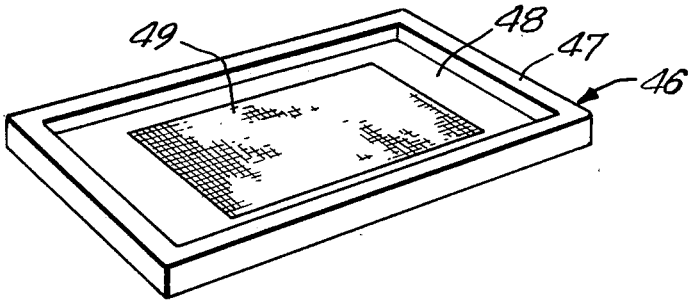
FIG. 3 is a perspective view of a frame mounted screen used in the machine of FIGS. 1 and 2.

A conventional framed screen unit 46 is shown in FIG. 3 consisting of a rectangular frame 47, screen 48 and pattern 49. The details for mounting the screen unit 46 can best be seen in FIGS. 11 to 16.

The head frame assemblies are all identical in construction consisting of parallel frame members, 26 and 27, to which are joined a pair of parallel horizontally disposed spaced apart rails 50 and 51 on which is mounted a carriage assembly 52 by means of chopper blocks 53 and 54 located at opposite ends of the carriage assembly. A motive device, e.g., a motor, 55 drives a shaft 56 through a gear train assembly 57. The shaft 56 connects with sprocket and chain loops 58 and 59 linked to the chopper blocks 53 and 54 for selectively transporting the carriage assembly 52 between terminal points 60 and 61. Parallel mounts 62 and 63, one for a flood bar 29 and one for a squeegee blade 30, are moveably mounted between chopper blocks 53 and 54 for vertical movement relative thereto. Each of the mounts 62 and 63 is connected at its ends to a vertical slide 64, 65, 66 and 67, mounted respectively in a corresponding keyhole cross-section vertical slot in the respective chopper blocks. Adjustment knobs 68 are arranged to provide manual adjustment for the vertical positioning of pivot plates 69 relative to the respective slide 64 to 67. A pneumatic actuator 70 carried by each chopper block is arranged to impart vertical movement to the associated slide 64 to 67 for positioning the latter in either a raised or lowered position relative to the associated chopper block.

Clamps 71 are provided for removeably securing either a squeegee 30 or a flood blade 29 in the respective mounts 63 and 62.

Figure 12:
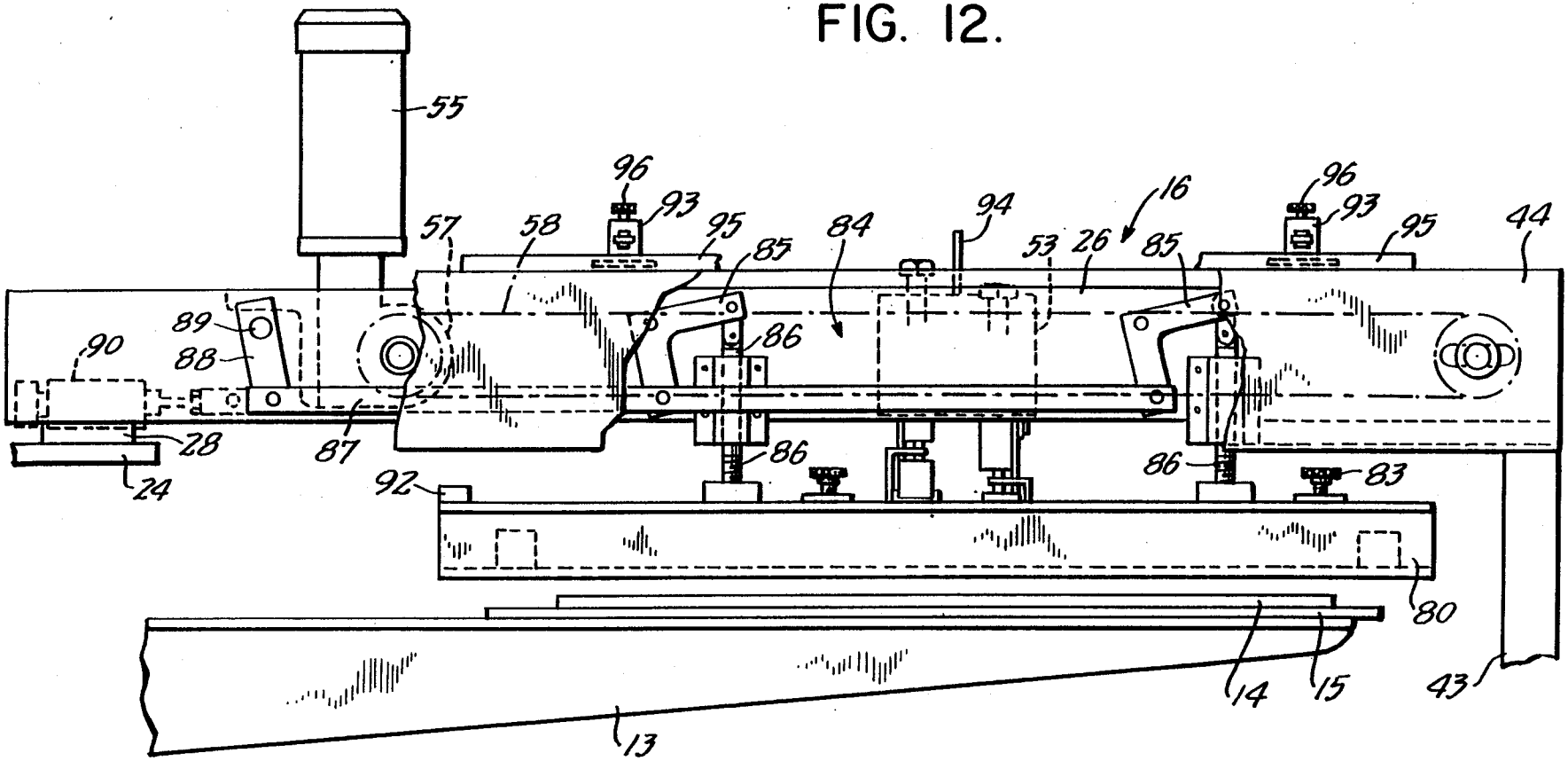
FIG. 12 is a vertical elevational view of the printing head assembly of FIG. 11.

A pair of parallel flanges 80 and 81 are provided spaced apart for receiving a frame-mounted printing screen 46, of the type shown in FIG. 3. The screen 46 is adjusted relative to the head frame by thumbscrews 82 and clamped in position by thumbscrews 83. A parallel motion linkage 84, best seen in FIG. 12, is used to suspend the flanges 80 and 81 from the printing head frame assembly 16 for selectably raising and lowering the screen 46 carried by the flanges 80 and 81 in parallelism to the plane of the printing head frame assembly. The linkage 84 consists of bell cranks 85 joined to the flanges 80 and 81 by adjustable rods or links 86 and joined by an operating bar 87, the latter being manipulated by the end of crank arm 88 driven by shaft 89. A similar bell crank arrangement is provided on both sides of the head frame. Another pneumatic actuator 90 provides power for moving the bell crank drive bar 87 on one side of the frame, and through shaft 89 the operating bar bell crank assembly on the opposite side of the head frame.

Figure 11:
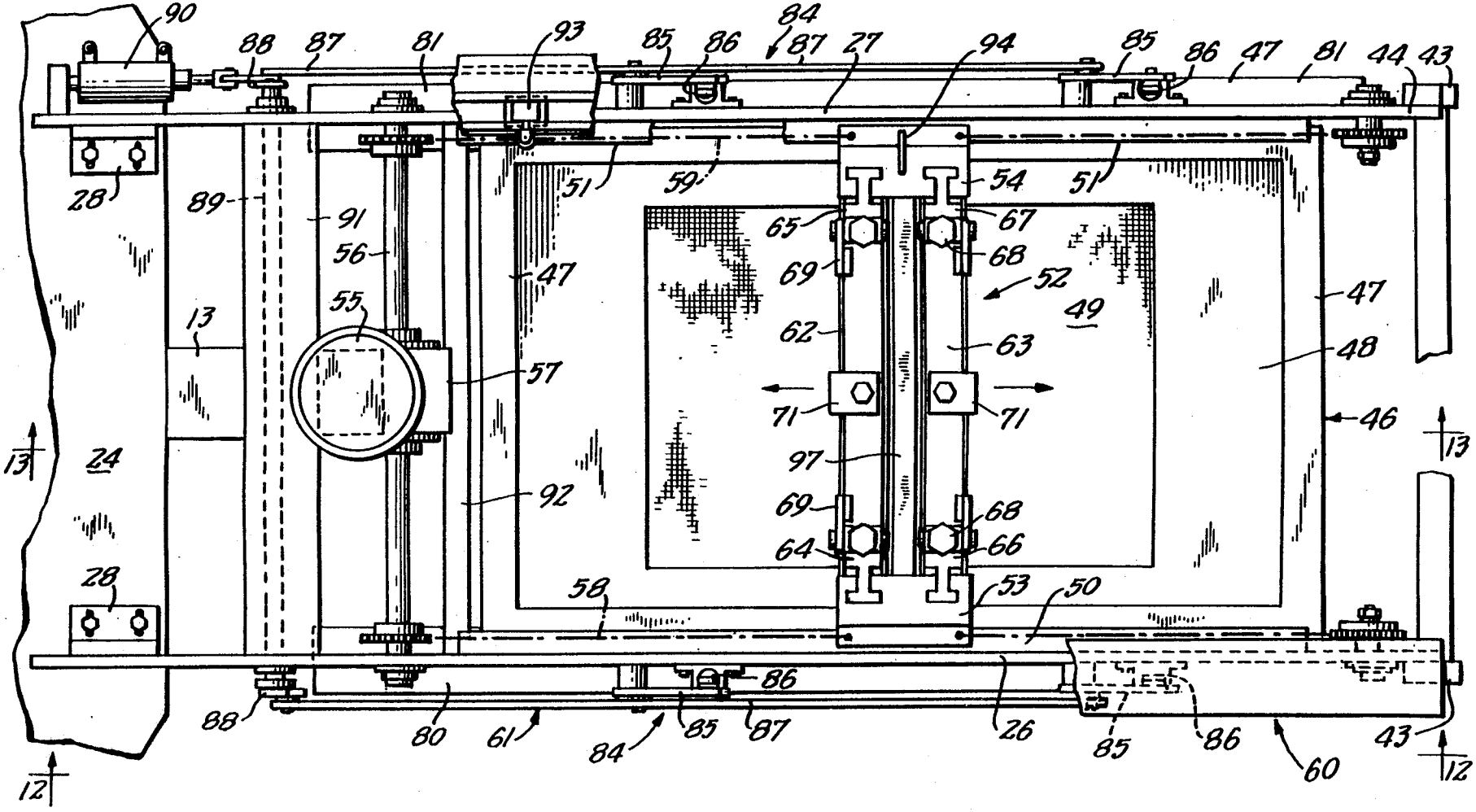
FIG. 11 is a fragmentary top plan view of one of the printing head assemblies used in the structure of FIG. 1.
Figure 13:
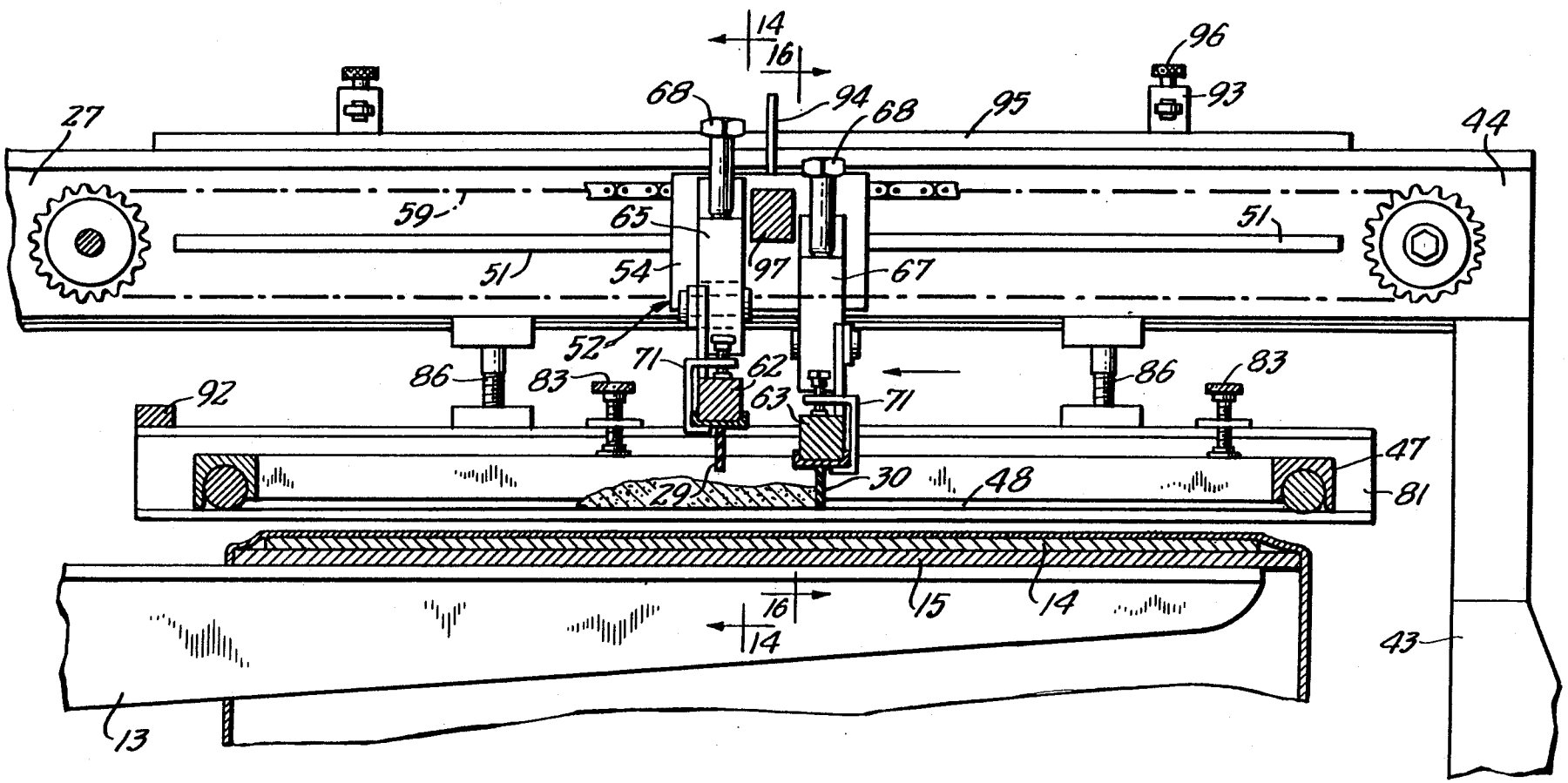
FIG. 13 is a view similar to FIG. 12 but taken as a section along line 13—13 in FIG. 11.
Figure 14:
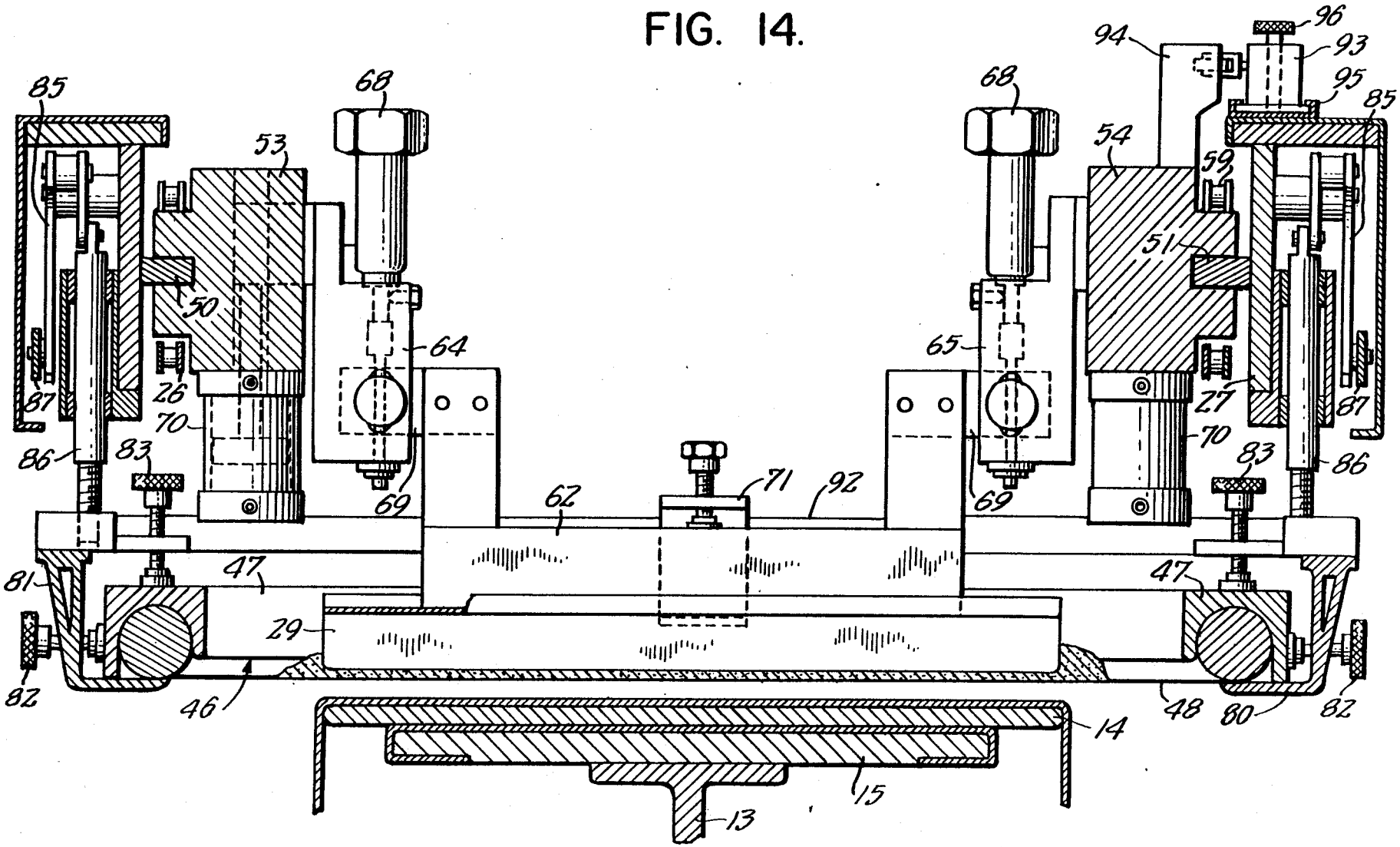
FIG. 14 is a front elevational view of the embodiment of FIG. 11 with the flood bar down.
Figure 15:
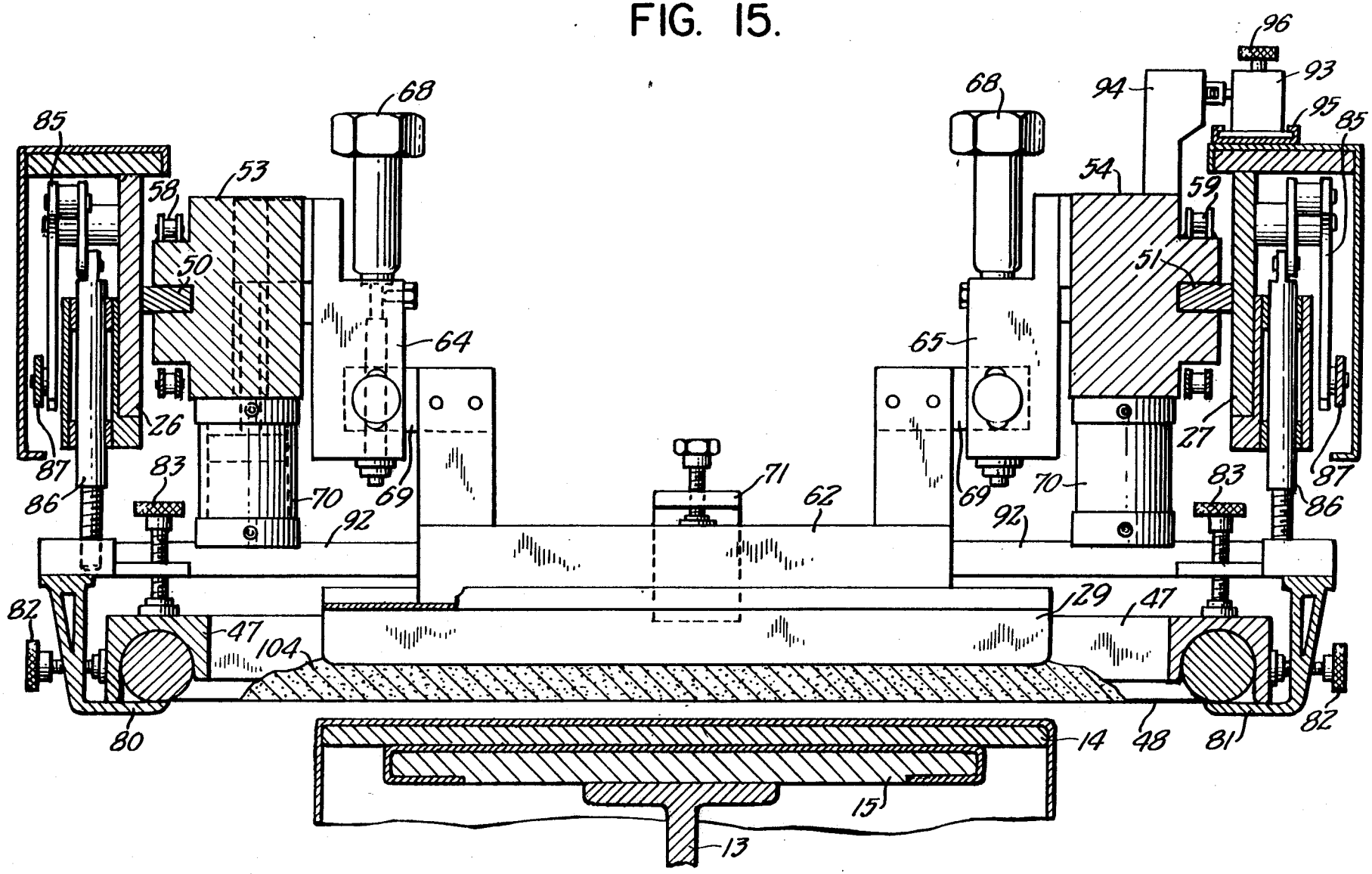
FIG. 15 is a view similar to FIG. 14 but with the flood bar elevated.

Referring to FIG. 11, the radial beam or side frame members 26 and 27 are stabilized structurally by a tie bar 91. In similar fashion, the flanges 80 and 81 are joined by a cross bar 92 as shown in FIGS. 12 and 13.

Control of the terminal points 60 and 61 for the horizontal movement of the carriage 52 is provided by a pair of adjustable microswitches 93, best seen in FIGS. 12 and 14 to 16, which microswitches are engaged and actuated by a striker plate 94 mounted atop chopper block 53. The microswitches ride in a slide channel 95, see FIG. 14, and are clamped in desired position along the head frame member 26 by a thumbscrew 96.

Figure 16:
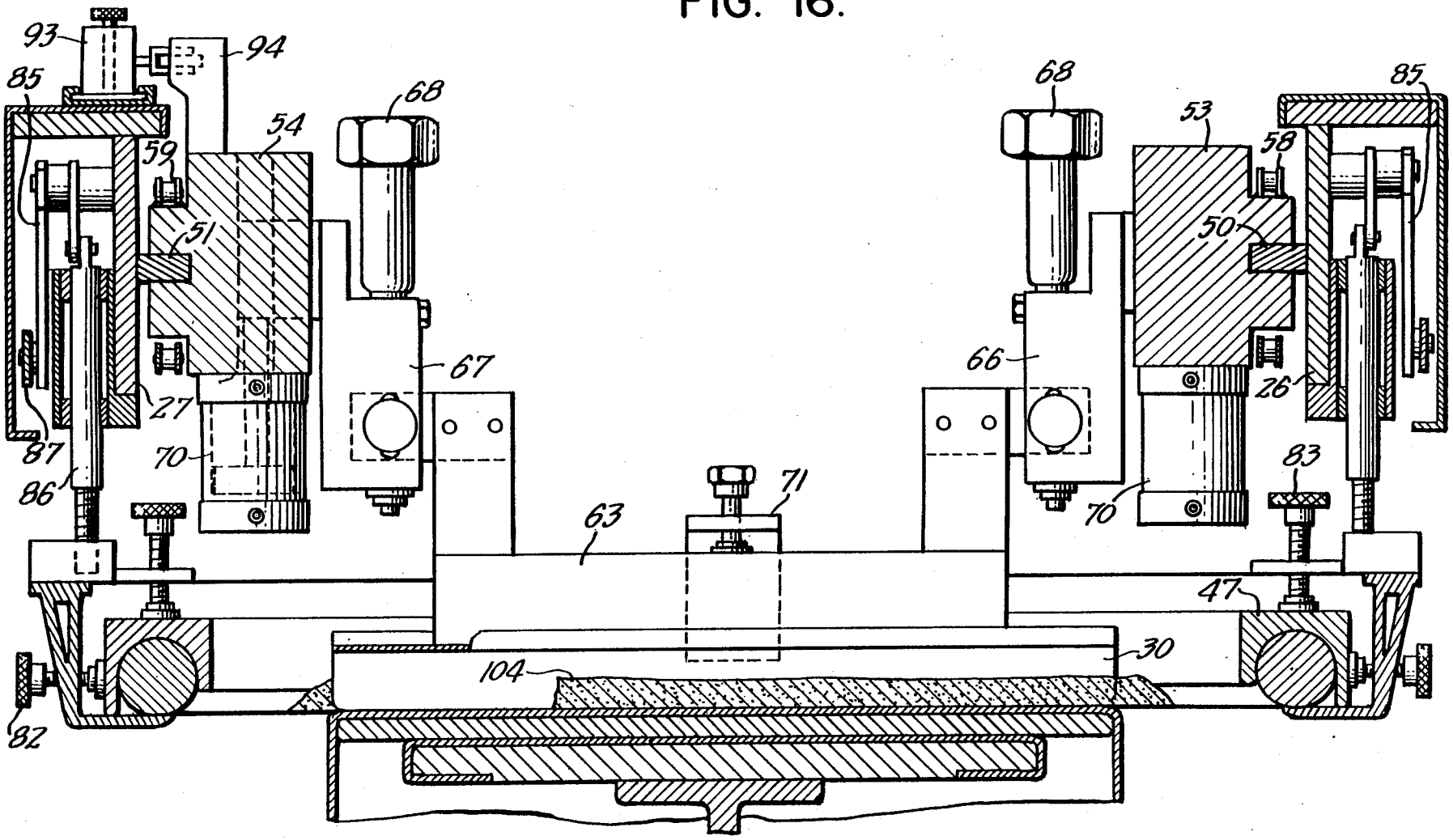
FIG. 16 is a view similar to FIG. 15, but with the squeegee in stroke operative position.

The carriage 52 is unified by a tie bar 97 joining the two chopper blocks 53 and 54. This is best seen in FIGS. 11, 13 and 16.

Referring to FIG. 1, it will be observed that between printing head frame assemblies 16 and 23 there is a large gap where two pallet arms 13, designated generally as 100 and 101, are not covered by a printing head frame. These locations provide for a loading and unloading station, respectively, based upon the assumption that the pallet arms 13 will revolve counterclockwise under the printing heads 16 to 23, as viewed in FIG. 1. Control over the operation of the machine 10 is obtained via a control console 102, suspended from the end of a swingable boom 103. The details of the control system for timing the various operations to be described do not form a part of the present invention. It is believed that knowing the intended operating sequence to be explained hereinafter, one skilled in the subject art will be able to provide suitable controls to carry out such operation.

Basically, as illustrated diagrammatically in FIGS. 4 to 10, a printing operation commences with the screen supporting flanges 80 and 81 elevated along with both flood bar 29 and squeegee blade 30, and with the carriage 52 rearward toward the cap 24 at location 61. A screen 46 is inserted and aligned over an underlying pallet 14 on which an article of clothing or the like has been installed. Thumbscrews 82 are used for this purpose whereupon the screen is locked in place by thumbscrews 83. Next a quantity of printing ink 104 is spread over the screen 48, and with the carriage 52 and screen 46 in the position shown in FIG. 4 relative to the article 105, the setting of the flood bar 29 is adjusted by manipulating the knobs 68 on slides 64 and 65. Knobs 68 control threaded shafts along which ride internally threaded members having projecting studs that connect with the pivot plates 69. Thus the clearance between the bar 29 and screen 48 can be adjusted as desired for a flooding stroke and the orientation of the operative edge of the bar can be altered to ensure parallelism with screen 48.

Figure 5:
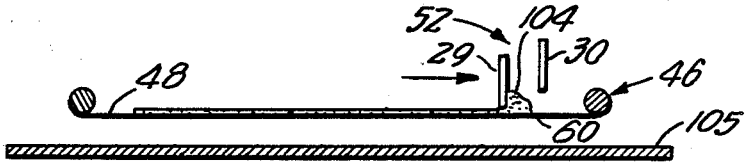
Figure 6:
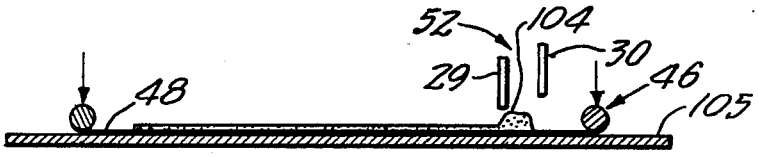
Figure 7:
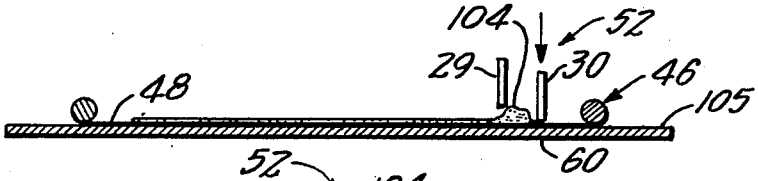
Figure 8:
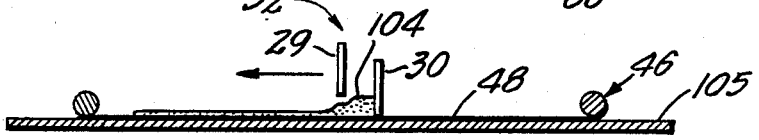
Figure 9:
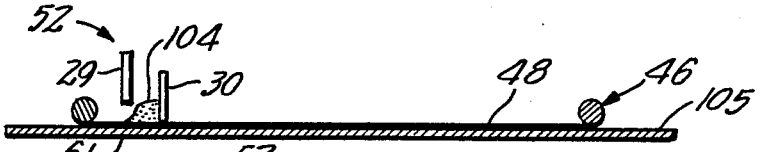
Figure 10:
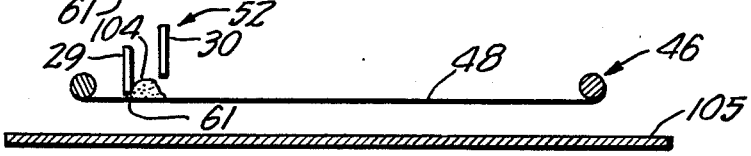

Next, the carriage drive motor 55 is activated to transport carriage 52 to its opposite terminal position at point 60 and this location can be adjusted as needed. FIG. 5 illustrates the flooding stroke. Then, as, shown in FIG. 6, actuator 90 is operated to lower screen 46 onto article 105, and this is followed by actuation of the actuators 70 in chopper blocks 53 and 54 to lower the squeegee 30 into contact with screen 48. Suitable adjustment of squeegee 30 can be effected as needed by manipulating the appropriate knobs 68. The resultant position is shown in FIG. 7. FIG. 8 shows the next step during which motor 55 is reversed to move carriage 52 through a printing stroke returning to position 61 as shown in FIG. 9, whereupon the actuator 90 is operated to raise screen 48 into proximity with flood bar 29 thereby arriving at the position of FIG. 10 which represents a completion of the cycle.

From an overall consideration of the screen printing machine 10 as seen in FIGS. 1 and 2 it should be apparent that the printing head frames 16 to 23 are integrated into a boxlike rigid skeletal machine frame. Each printing head frame extends radially outwardly from the central top cap to the vertical standards 43 that are joined by outriggers 45 to the central base 11. This structure is extremely steady and resists vibration when in operation. The vertically selectably reciprocable screen frame mount along with the vertically reciprocable and horizontally translatable squeegee assembly enables the printing head frame to function while the head frame remains stationary as part of the machine superstructure. The major structural portion of the printing head is now stationary with the moving parts considerably lighter in weight and subject to higher speed operation.

Figure 17:
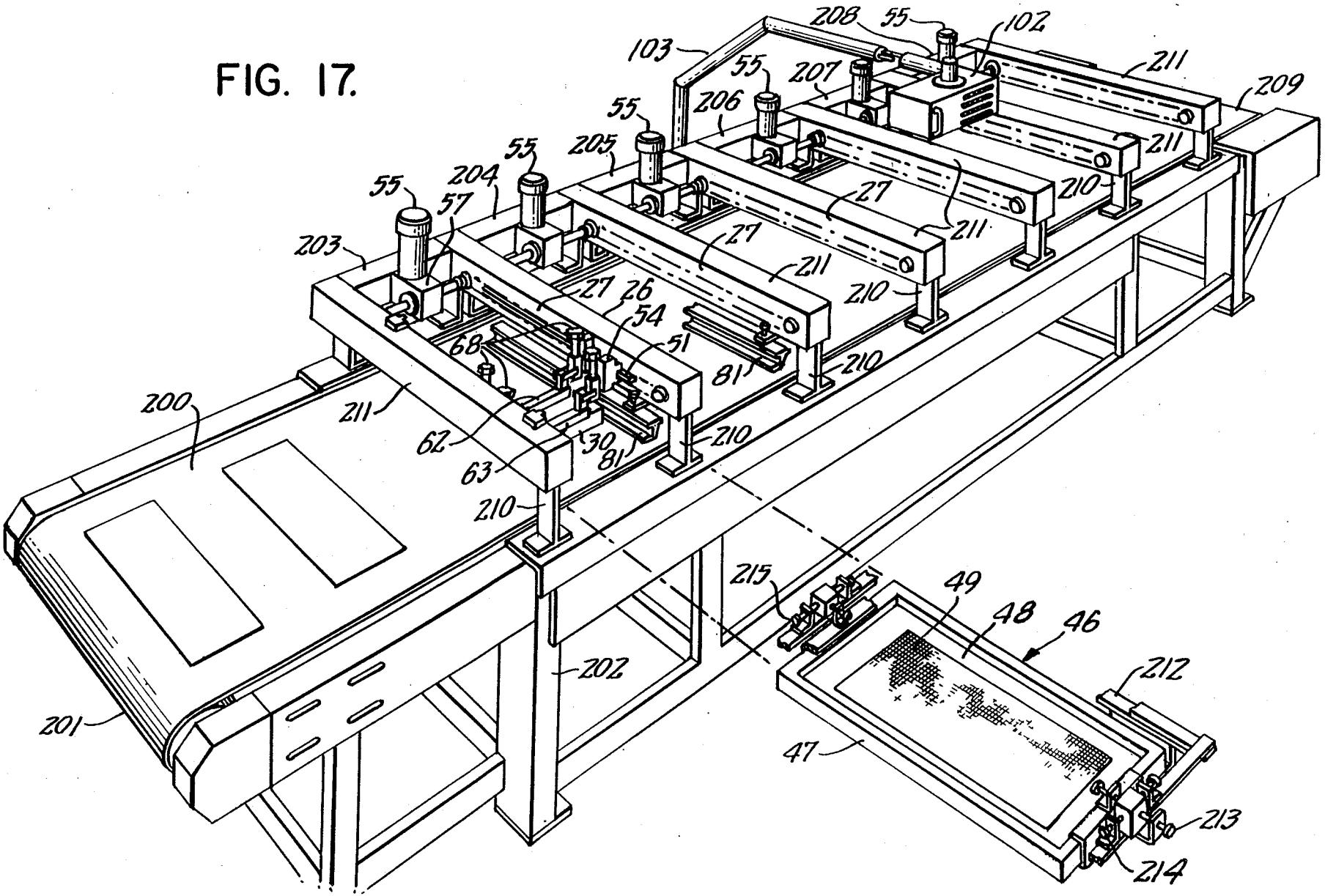
FIG. 17 is a perspective view of another embodiment of the invention.

The same principle that underlies the embodiment of FIG. 1 wherein the pallets are on a revolving structure can be applied to a linear or web printer as illustrated in FIG. 17. Here the material to be imprinted may be a bolt of fabric 200 supplied from a roll 201 at one end of a table base 202 advanced along the table under a series of printing head frames 203 to 208 to a take up roll 209. The printing head frames 203 to 208 can be constructed substantially the same as the head frames 16 to 23 previously described and, thus, the corresponding parts have been indicated with the same reference numerals. As shown in FIG. 17, the side frame members 26 and 27 are joined to the supporting base table structure by vertical standards 210 at both ends of the frame members. As between adjacent frames such as 203 and 204, the side frame bars 27 of frame 203 and 26 of frame 204 are mounted back-to-back under a common cover or housing 211.

Unlike the arrangement in FIGS. 11 to 16 for adjusting the screen position relative to flanges 80 and 81, the screens in FIG. 17 are provided with a specially constructed mounting frame 212 having a series of thumbscrew adjustments 213, 214 and 215 for achieving movement in all directions.

Having described the invention with reference to the presently preferred embodiments thereof, it is to be understood that various changes in construction can be introduced as will occur to those skilled in the subject art without departing from the true spirit of the invention as defined in the appended claims.

What is claimed is:

1. A screen printing machine comprising in combination a central base structure supporting thereupon a rotatable column, a plurality of circumferentially spaced radial arms projecting from said column and supporting each a corresponding pallet at the same radial distance from said column and in a common plane for receiving a fabric article to be screen printed, a plurality of printing head frame assemblies disposed in another common plane parallel to and spaced from said pallet common plane, said printing head frame assemblies being located about a circle spaced from one another and positioned radially from said column so that, for each of a plurality of indexable locations of said rotatable column, each printing head frame assembly will be aligned in juxtaposition with a different pallet, and machine frame members interconnecting one end of each said printing head frame assembly with said rotatable column and connecting the opposite end of each said printing head frame assembly with said base structure whereby said printing head frame assemblies are integrated into a boxlike rigid skeletal machine frame, and means supported by each said printing head frame assembly for transferring a screen into a position proximate to a pallet-supporting article in a manner to permit screen printing onto said article, wherein each said printing head frame assembly and said means supported thereby comprise a single integrated unit located entirely on one side of said pallet common plane.

2. A screen printing machine according to claim 1, wherein said planes are horizontally oriented and said plane of printing head frame assemblies is located above said plane of pallets, and said machine frame members comprise a central cap portion including a centered upper bearing for said rotatable column, said printing head frame assemblies comprising radial beams joined at one end to said cap portion and extending radially outwardly in pairs spaced circumferentially with each pair defining a stationary printing station, and vertical standards interconnecting the free ends of said beam with radially extending extensions projecting from said central base structure.

3. A screen printing machine according to claim 2, wherein said means supported by each said printing head frame assembly comprises a vertically selectable reciprocable screen frame mount in combination with a vertically reciprocable and horizontally translatable squeegee assembly for sequentially lowering a screen into contact with a fabric article on a pallet and thereupon translating said squeegee to urge printing fluid through said screen.

4. A screen printing machine according to claim 1, wherein said means supported by each said printing head frame assembly comprises a selectably reciprocable screen frame mount in combination with a reciprocable and translatable squeegee assembly for sequentially displacing a screen into contact with a fabric article on a pallet and thereupon translating said squeegee to urge printing fluid through said screen.

5. A screen printing machine according to claim 4, wherein said squeegee assembly comprises a carriage mechanism mounted for movement in a horizontal plane between two points relative to said printing head frame assembly, a vertically moveable mount for a flood bar suspended from said carriage mechanism so as to position a flood bar transverse to a line connecting said two points, a vertically reciprocable mount for a squeegee blade suspended from said carriage mechanism so as to position a squeegee blade parallel to said flood bar mount, and means for sequentially translating said carriage from one of said two points to the other with said screen frame mount in elevated position to flood a quantity of printing fluid across said screen, thereafter lowering said screen frame mount to place a screen there supported down upon an underlying article, accompanied by a lowering of said squeegee mount so that a mounted squeegee blade is in operative engagement with said screen, thereafter translating said carriage back to said one of said points while urging printing fluid through said screen, and thereafter raising said squeegee blade mount and said screen frame mount.

6. A screen printing machine according to claim 5, wherein said carriage mechanism includes pneumatic actuators for vertically moving said flood bar mount, and pneumatic actuators for vertically reciprocating said squeegee blade mount.

7. A screen printing machine according to claim 6, wherein said means supported by said printing had frame assembly for screen printing comprises a bell crank suspension suspending said screen frame mount below said printing head frame assembly for moving a screen that is disposed in said screen frame mount between raised and lowered parallel plane positions.

8. A screen printing machine comprising in combination a plurality of printing head frame assemblies disposed in a common plane, means for supporting and advancing in a second plane, spaced from and parallel to said common place, a quantity of fabric onto which printing is to be effected, means for advancing said fabric to sequentially locate a predetermined area of said fabric in registration with a different one of said printing head frame assemblies, and machine frame members interconnecting each end of said printing head frame assemblies with a machine base structure whereby said printing head frame assemblies are integrated into a rigid skeletal machine frame, and means supported by each said printing head frame assembly for screen printing upon said fabric when said predetermined area is in juxtaposition with the corresponding printing head frame assembly wherein said means supported by each said printing head frame assembly comprises a vertically selectably reciprocal screen frame mount in combination with a vertically translatable squeegee assembly for sequentially lowering a screen into contact with said fabric article and thereupon translating said squeegee to urge printing fluid through said screen, and wherein each said printing head frame assembly and said printing means supported thereby comprise a single integrated unit located entirely on one side of said second plane.

* * * * *